US009770385B2

(12) United States Patent
Schwirian et al.

(10) Patent No.: US 9,770,385 B2
(45) Date of Patent: Sep. 26, 2017

(54) COMPRESSION THERAPY DEVICE HAVING MECHANICAL ADVANTAGE

(71) Applicant: Circulator Boot Company, Columbus, OH (US)

(72) Inventors: Jay Schwirian, Monongahela, PA (US); Brad Yakam, New Albany, OH (US); Tushar Shah, Newtown Square, PA (US)

(73) Assignee: Shakam LLC, Columbus, OH (US)

( * ) Notice: Subject to any disclaimer, the term of this patent is extended or adjusted under 35 U.S.C. 154(b) by 260 days.

(21) Appl. No.: 14/508,365

(22) Filed: Oct. 7, 2014

(65) Prior Publication Data

US 2016/0095787 A1 Apr. 7, 2016

(51) Int. Cl.
*A61H 1/00* (2006.01)
*A61H 9/00* (2006.01)

(52) U.S. Cl.
CPC ... *A61H 9/0078* (2013.01); *A61H 2201/0173* (2013.01); *A61H 2201/1207* (2013.01); *A61H 2201/1246* (2013.01); *A61H 2201/1642* (2013.01); *A61H 2201/5012* (2013.01); *A61H 2201/5015* (2013.01); *A61H 2201/5046* (2013.01); *A61H 2201/5071* (2013.01); *A61H 2201/5097* (2013.01); *A61H 2230/065* (2013.01)

(58) Field of Classification Search
CPC ..... A61H 9/0078; A61H 2201/1642; A61H 2201/5012; A61H 2201/0173; A61H 2201/5071; A61H 2201/5097; A61H 2201/5046; A61H 2201/5015; A61H 2201/1246; A61H 2230/065; A61H 2201/1207
See application file for complete search history.

(56) References Cited

U.S. PATENT DOCUMENTS

| | | | | |
|---|---|---|---|---|
| 3,734,087 | A | 5/1973 | Sauer | |
| 3,795,242 | A * | 3/1974 | Lerch | A61H 9/0078 601/152 |
| 4,478,214 | A | 10/1984 | Lamont | |
| 5,245,990 | A | 9/1993 | Bertinin | |
| 5,383,842 | A | 1/1995 | Bertini | |
| 5,554,103 | A | 9/1996 | Zheng et al. | |
| 5,711,760 | A | 1/1998 | Ibrahim et al. | |
| 6,361,512 | B1 | 3/2002 | Mackay et al. | |
| 6,572,621 | B1 | 6/2003 | Zheng et al. | |
| 6,589,194 | B1 | 7/2003 | Calderon et al. | |
| 6,589,267 | B1 | 7/2003 | Hui | |
| 6,736,786 | B1 | 5/2004 | Shabty et al. | |
| 6,984,215 | B2 | 1/2006 | Shah et al. | |
| 7,044,924 | B1 | 5/2006 | Roth et al. | |

(Continued)

OTHER PUBLICATIONS

International Patent Application No. PCT/US2015/054129; Int'l Search Report and the Written Opinion; dated Jan. 19, 2016; 10 pages.

(Continued)

*Primary Examiner* — Quang D Thanh
(74) *Attorney, Agent, or Firm* — Baker & Hostetler LLP

(57) ABSTRACT

A compression therapy device for vascular diseases and other therapies including a bladder a lever arm acting on the outer surface of the bladder such that cyclical operation of an actuator on the lever arm creates cyclical changes in pneumatic pressure in the therapeutic portion of the bladder.

15 Claims, 7 Drawing Sheets

(56) References Cited

U.S. PATENT DOCUMENTS

| | | | | |
|---|---|---|---|---|
| 7,258,676 | B2 | 8/2007 | Calderon et al. | |
| 8,100,841 | B2 | 1/2012 | Rousso | |
| 8,449,483 | B2 | 5/2013 | Eddy | |
| 8,579,792 | B2 | 11/2013 | Pickett et al. | |
| 2010/0063427 | A1* | 3/2010 | Ingrao ..... | A61H 1/003 601/90 |

OTHER PUBLICATIONS

International Patent Application No. PCT/US2015/054129; Int'l Preliminary Report on Patentability; dated Apr. 20, 2017; 8 pages.

* cited by examiner

COMPRESSION THERAPY DEVICE HAVING MECHANICAL ADVANTAGE

TECHNICAL FIELD

The present disclosure relates to a compression device for applying cyclic external pressure to the outer surface of a patient receiving compression therapy. In particular, the present disclosure relates to a compression device that utilizes a lever advantage to cyclically apply pressure to a limb requiring compression therapy efficiency and precision.

BACKGROUND

Compression therapy systems are used in several medical applications to apply rapid compressions to one or more appendages (e.g., arms, hands, legs, and feet) of a body. For example, compressions therapy systems are used to treat chronic wounds by applying pressure to an appendage having wounds to improve circulation around the wounds, or to improve blood circulation to treat angina or congestive heart failure (CHF), e.g., as in enhanced external counter-pulsation (EECP) devices.

In some prior art compression therapy systems, a compressor may be utilized to compress air for storage into a storage tank. The stored air is then delivered from the storage tank to the inflatable compression device through a valve in rapid low pressure bursts to apply compression to the appendage. After each burst of air fills the inflatable device, another valve is opened on the release the air to the ambient conditions thereby removing compression from the appendage being treated. While such prior art systems may have had utility, the continuous need for significant amounts of air from the storage tank require the use of a relatively large compressor requiring significant amount of power and capital expense. Further, in some instances, it may be difficult for the compressor to keep up with the rapid cycling required of particular applications, and/or the valving used may not be precise enough to provide compression as precisely as desired.

Accordingly, some prior art similar systems have attempted to address some of these issues. For example, U.S. Pat. No. 6,984,215 to Shah ("Shah") discloses a compression therapy system that utilizes a piston system and a supplementary bladder to overcome some of the aforementioned issues. In particular, instead of venting to the ambient air, the system disclosed in Shah utilizes a supplementary bladder and valve such that the air that would otherwise be vented and compensated for by the compressor of prior art systems is recycled by a bladder and forced back into the compression device by direct compression from a piston.

While the Shah disclosure represents an improvement over prior-art systems in efficiency and control, the direct use of a piston, operating directly on the compressed air in a supplementary bladder, is not as mechanically efficient as possible. Additionally, such a system may require complex and expensive piston position sensors in order to ensure that the use of the piston doesn't exceed the maximum pressure in the compression device, the potential failure of which could potentially result in significant patient injury. Accordingly, it would be desired to have a system and method for providing cyclic compression to a therapeutic device which is more efficient than prior art designs, does not require complex and expensive position sensors, and which provides a fail-safe for potential over-inflation of the compression device.

SUMMARY

The present disclosure provides a compression therapy device for vascular diseases and other therapies that overcomes some of the deficiencies of prior art compression devices. The compression device of the present disclosure may include a bladder including a therapeutic portion, a reservoir portion and a lever arm acting on the reservoir portion. In embodiments of the present disclosure, a compression therapy device may be provided that is specifically adapted for use on a patient's lower leg and foot and may be boot-shaped. The compression therapy device disclosed herein may be adapted and sized to receive a patient's foot and calf therein and may include an anterior portion that opens and closes, allowing for the patient's foot and calf to be inserted and removed. The therapeutic portion may surround the patient's calf when in the boot and the reservoir portion may be positioned anywhere in fluid communication with the therapeutic portion. There may be a constriction in the bladder between the therapeutic portion and the reservoir portion. A lever arm may be provided and arranged in such a way as to apply pressure to the reservoir portion, thereby forcing air into the therapeutic portion. An actuator, such as a piston, solenoid or other mechanical device, may be provided to operate the lever arm between an extended, non-compression position wherein the reservoir portion is allowed to expand and a retracted, compression position in which pneumatic pressure from the reservoir portion is forced into the therapeutic portion of the provided bladder.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
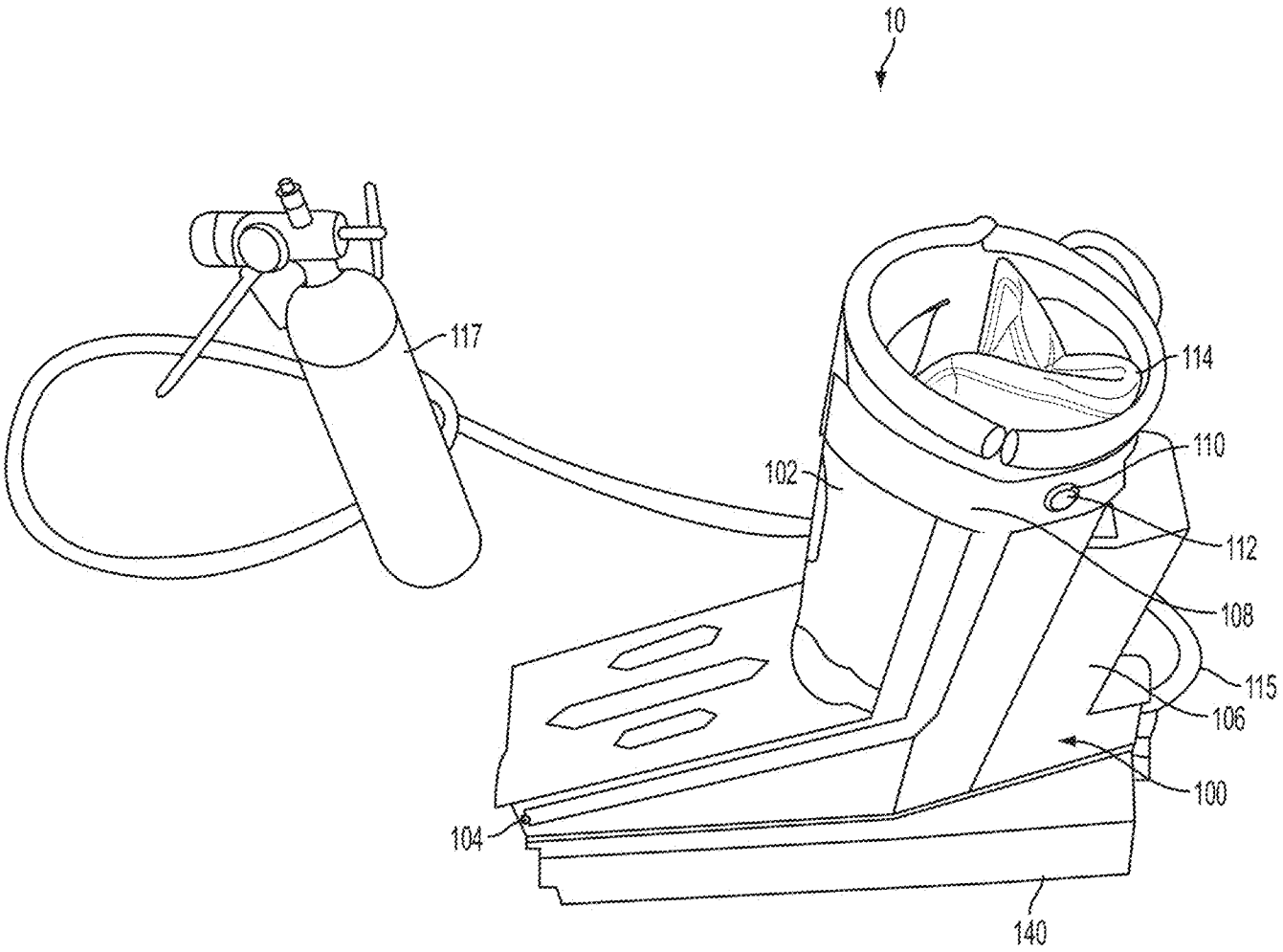
FIG. 1 is a side perspective view of an example embodiment of a compression therapy device consistent with aspects of the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
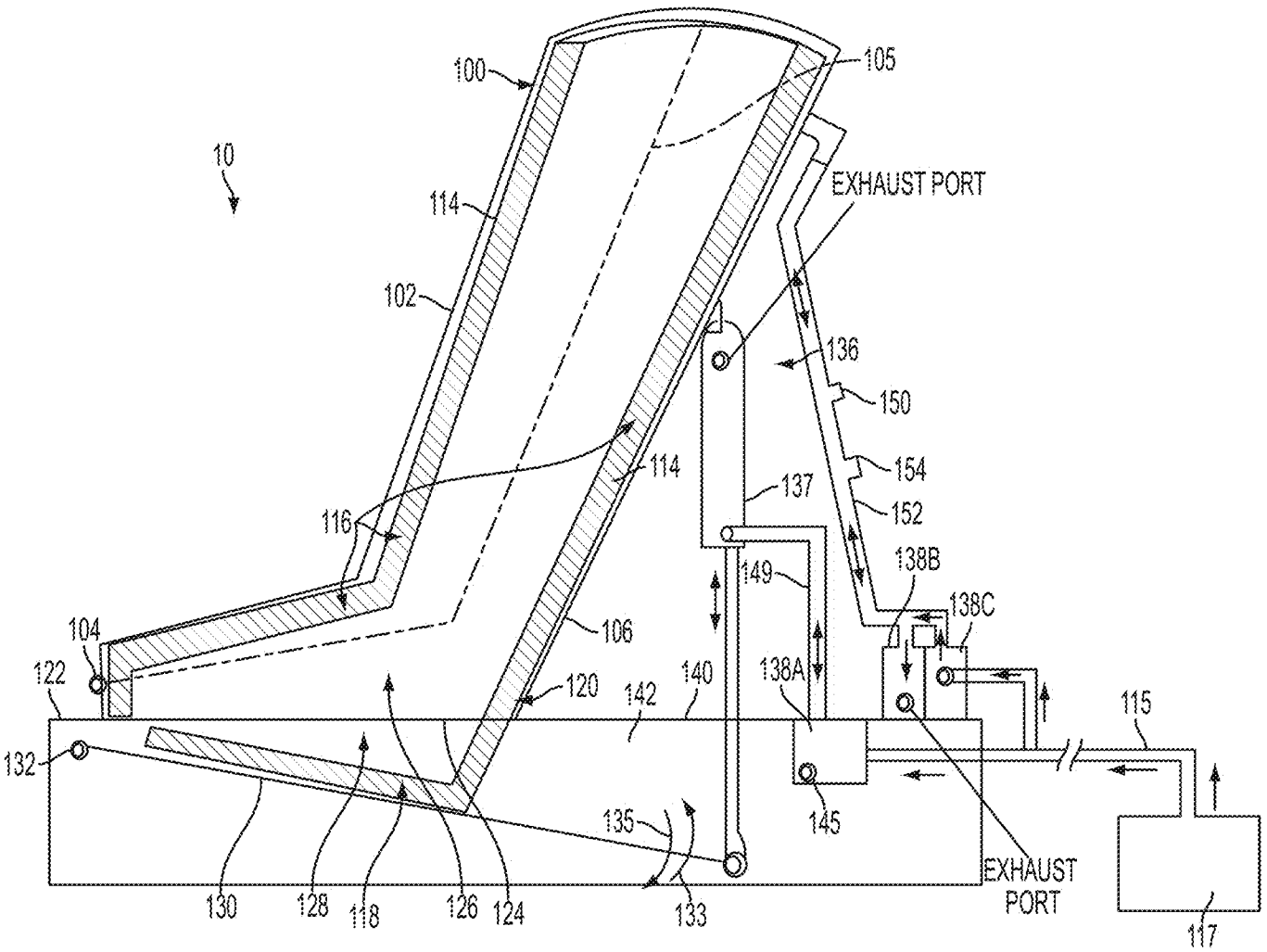
FIG. 2 is a partially schematic side view of the example compression therapy device of FIG. 1.

As shown in FIGS. 1 and 2, a therapeutic compression device 10 may be provided in the form of a boot 100. The boot 100 may be sized and shaped to receive a patient's foot and lower leg therein and may include an anterior portion 102 that opens and closes about a hinge 104 approximate the toe of the boot 100 and a posterior portion 106 (in the current embodiment, the anterior portion 102 pivots up an away from the posterior portion 106 to open the boot). Pivoting open the anterior portion 102 about hinge 104 allows for the patient's foot and calf to be inserted and removed from the boot 100 (the broken line FIG. 2 illustrates the boundary 105 between the anterior portion 102 and posterior portion 106 when closed). In the current embodiment, the anterior portion 102 includes covers the patient's shin and top of the patient's foot, and the posterior portion covers the patient's calf and the back and bottom of the patient's foot. The boot 100 may include a strap 108 (or any other suitable clamping or locking mechanism) to secure the anterior portion 102 to the posterior portion 106 when the patient's foot and lower leg is received therein. In the current embodiment the strap 108 is fixedly attached on one end (not shown) to the posterior portion 106 and the strap 108 may include a hole 110 on the other end thereof. The strap may extend across the anterior portion 102 and may be coupled to a diametrically opposite end of the posterior portion from which it is attached by mating the hole 110 onto receiving a nub 112 located on the base portion 106 thereby securing the anterior portion 102 to the posterior portion 106. In an embodiment of the disclosure, in the closed, therapeutic position, the anterior portion 102 and posterior portion are designed such that the angle of the patient's shin/calf with respect to the patient's foot may be between 15 and 20 degrees, and more preferably, approximately 18 degrees.

Surrounding the patient's foot and lower leg, when in the boot 100, may be a bladder 114. The bladder 114 may be filled with air (or another gas, fluid or non-Newtonian fluid) to provide pneumatic pressure around a patient's limb when inserted in the boot 100 by means of a pneumatic supply line 115 that is attached to a pneumatic pressure source 117. The bladder 114 may include a therapeutic portion 116 and a reservoir portion 118. In the current embodiment, the anterior portion 106 extends from a base 140 that provides a working chamber 142 below the boot 100. The reservoir portion 118 extends into the working chamber 142 and may be connected to the therapeutic portion 116 by a constriction 120. The boot 100 may have an inner floor 122 for separating the boot 100 from the working chamber 142 and for supporting a foot of a patient thereon. The constriction 120 of the bladder 114 may extend through an orifice or hole 124 in the inner floor 122 to connect the therapeutic portion 116 of the bladder 114 with the reservoir portion 118 of the bladder 114. The inner floor 122 may be used to separate a therapy chamber 126 of the boot 100 from a reservoir cavity 128 portion of the working chamber 142.

The reservoir portion 118 may be located primarily in the working chamber 142 of the base 140 and be positioned between the inner floor 122 and a lever arm 130 that is mounted on one end thereof to a hinge or pivot 132 for pivotal movement within working chamber 142. In the current embodiment, the anterior end of the lever arm is coupled to the pivot 132 approximate the toe portion of the boot and extends posteriorly across the inner floor and provides the reservoir cavity 128 between the lever arm 130 and the inner floor 122 into which the reservoir portion 118 of the bladder is positioned. On the posterior end of the lever arm 130, an actuator 136 is mounted so as to affect pivotal movement of the lever arm 130 about the pivot 132 in compression 133 (up towards inner floor 122) and release 135 (down away from inner floor 122) directions. It will be understood, in accordance with the disclosure, that actuator 136 could be a piston, servo, solenoid, air actuator, electrical linear actuator, cam with an electrical motor, etc. In accordance with one embodiment of the disclosure, the lever arm 130 and pivot may be located proximate a toe end of the boot 100, the actuator 136 may be located at a heel end of the boot 100, and the reservoir portion 118 of the bladder 118 may be positioned between the lever arm 130 and the inner floor 122.

Figure 3:
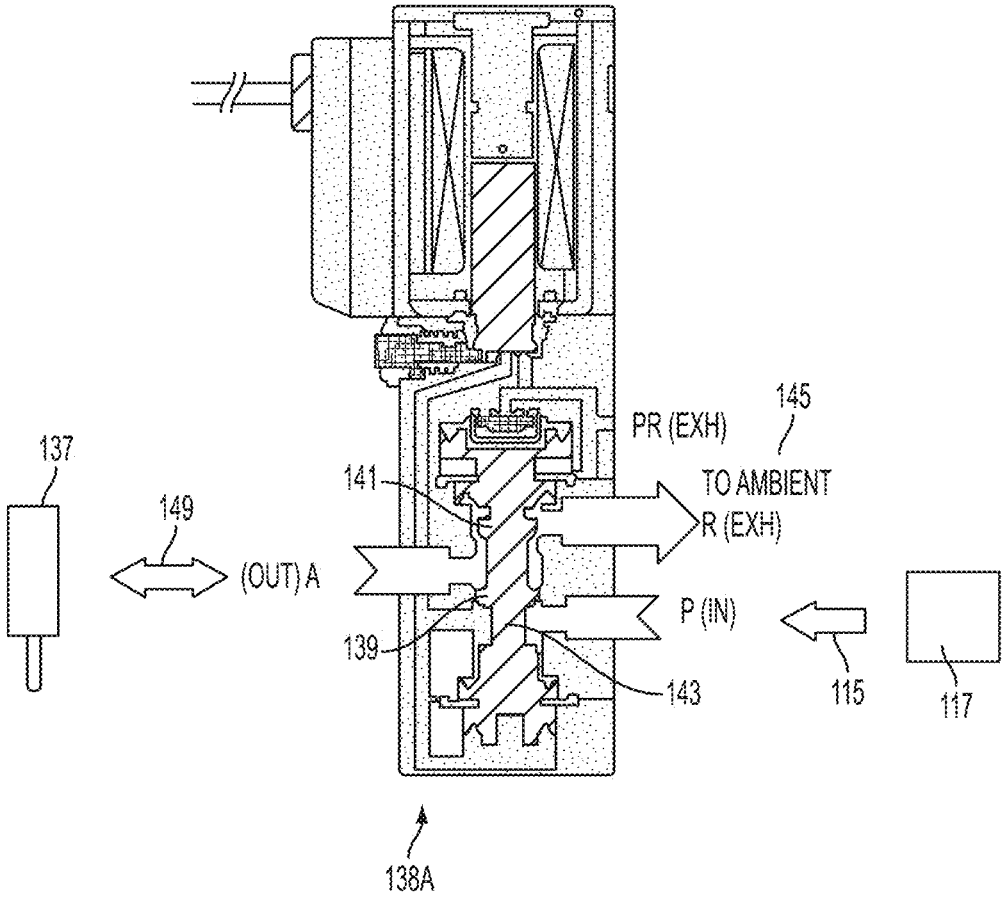
FIG. 3 is a partially schematic side view a three-way valve that may be used with the example compression therapy device of FIGS. 1 and 2.

In accordance with this embodiment, the reservoir portion 118 may be positioned such that actuation of the actuator 136, and the corresponding lever arm 130, in the compression 133 direction compresses the reservoir portion 118 against the bottom of the inner floor 122 creating a decrease in the volume of the boot 100 and a corresponding relative increase in pressure in the therapeutic portion 116 of the bladder 114. Conversely, actuation of the actuator 136 in the release direction 135, and the corresponding lever arm 130 (or the release of any resistance to movement thereof), allows expansion of the reservoir portion 118 of the bladder 114 into the reservoir cavity 128 thereby increasing the volume of the boot 100 and, correspondingly, decreasing relative pressure in the therapeutic portion 116 of the bladder 114. In this manner, a cyclic increase and decrease in pressure may be accorded in the therapeutic portion 116 of the bladder as may be desired. More specifically, cyclic compression therapy may be provided to a limb, such as a foot, ankle, and/or calf of a patient as desired. For example, the actuator 136 may be connected to a patient heart rate monitor (such as via an EKG monitor, finger-tip pulse monitor, wrist pulse monitor or the like) so that the pressure in the therapeutic portion 116 of the bladder 114 fluctuates between high and low pressure states in timing with a patient's heartbeat In the current embodiment, the actuator 136 includes a pneumatic driven piston 137 and a three-way valve 138A in fluid communication between the pneumatic supply line 115 and the piston 137. Referring to FIGS. 2 and 3, the three way valve 138 may have at least two settings, an energized setting in which the pneumatic pressure source 117 provides pneumatic pressure to the piston 137, causing the piston 137 to move lever arm 130 up in direction 133, and a de-energized setting, in which the air is evacuated from the piston 137. Pneumatic pressure source 117 may be a compressor, but may be any other pneumatic source or hydraulic source as known by those of ordinary skill. In the configuration of the valve 138A in FIG. 4, the pressurized air from pneumatic pressure source 117 P(IN) is blocked by o-ring 139 while o-ring 141 is un-blocked allowing air from piston, through line 149, to be exhausted out to the Ambient through R (EXH) 145. In this configuration, the valve 138A is in the de-energized setting. In an energized setting, the center shaft 143 moves vertically allowing o-ring 141 to block R (EXH) and o-ring 139 to unblock P (IN), allowing pressurized air from pneumatic pressure source 117 to flow through P (IN) and out (OUT) A and into piston 137 through line 149. In operation, in the current embodiment, when switching from the energized setting to the de-energized setting, pressure within the bladder 114 will force the lever arm 130 downward again (direction 135) forcing the air within the piston 137 will be evacuated out through the valve 138A. The three-way valve 138A allows rapid inflation and deflation of the piston 137 with one electric valve. It may also provide a safety feature in that deflation occurs in the case of power loss. With the current system, there is no particular requirement for the pneumatic pressure source (e.g., quick and precise response as may be required by prior art systems) other than the pneumatic pressure source 117 provide the amount of pressure for therapy.

Filling and deflating the bladder from the pneumatic source 117 involves a pair of one-way valves: an exhaust valve 138B and a fill valve 138C. To deflate the bladder 114, exhaust valve 138B is actuated and fill valve 138C is deactivated, allowing gas to flow from the bladder 114 through line 152 and out through an exhaust port in valve 138B. To fill the bladder 114, exhaust valve 138B is deactivated and fill valve 138C is activated, allowing gas to flow from the pneumatic pressure source 117 to the bladder 114 through line 152. When filling the bladder 114, the fill pressure will be at the maximum desired pressure for treatment, as discussed below. For example, the desired pressure for treatment of peripheral vascular disease is generally between approximately 50-60 mmHg. However, much higher pressures for different treatments (such as therapies for congestive heart failure) are contemplated and consistent with the present disclosure. The device 10 may also be configured with a pressure relief valve 150 to prevent over pressurization inflation of the bladder 114. Such a pressure relief valve 150 may be a poppet style and may be set at an opening pressure depending upon the purpose of boot. In an exemplary embodiment, the valve 150 be provided on line 152 and may have an opening pressure of 1.9 PSI. In an embodiment, line 152 may also include a pressure sensor 154.

Consistent with an embodiment of the disclosure, one general operation of the boot 100 to provide therapy to a patient may be as follows. Initially, the actuator 136 may be set to zero (compression) state by an operator meaning that the actuator 136 is set to the farthest travel in the compression direction 133. The valve 138B in the pneumatic supply line 115 may be opened to the vent setting thereby allowing bladder 114 to achieve atmospheric pressure therein. The anterior portion 102 of the boot 100 may be rotated forward allowing the patient to place his foot and lower leg within the therapeutic portion 116 of the bladder 114. Next, the anterior portion 102 may be rotated closed about the patient's ankle and the strap 108 may be wrapped around the anterior portion and secured to the posterior portion 106 by nub 112 thereby securing the patient's ankle and foot securely in the boot 100. Next the valve 138C may be positioned in the fill setting and, utilizing the pneumatic pressure source 117 and sensor 154, pneumatic pressure may be supplied to the bladder 114 up to the desired maximum therapeutic pressure (determined based upon the therapy being provided). Thereafter, the valves 138B and 138C may be positioned in the therapeutic setting, thereby sealing bladder 114 to egress and ingress of pneumatic pressure. At this time, the actuator 136 may be cyclically actuated according to the timing and duration required by the therapy being delivered. As discussed above, the timing may be determined using control systems known to those of ordinary skill in the art for timing the actuator based upon heartbeat, heart rate, and/or other physiological readings, or based on a predetermined timing cycle.

As can be seen best in FIG. 1, the boot 100 may be formed to surround and cover the foot and calf regions of a patient. However, it is to be understood that the precise extent of the body regions in contact with the therapeutic portion 116 of the bladder 114 may vary depending upon the type of condition being addressed and the location of the affected body region. Accordingly, it should be understood that many types of inflatable bladder designs may be readily adapted for use in conformance with the therapeutic compression device 10 disclosed herein, and therefore more detailed aspects of the bladder design including but not limited to size, shape, materials, forms of attachments, etc., are therefore omitted for sake of clarity. While a calf and foot therapeutic bladder is shown for illustration, other therapeutic bladders are envisioned to be equally suitable, such as for a calf alone, a foot alone, thigh, arm, hand, finger or toe, for examples, and are considered within the scope of the disclosure.

Figure 4:
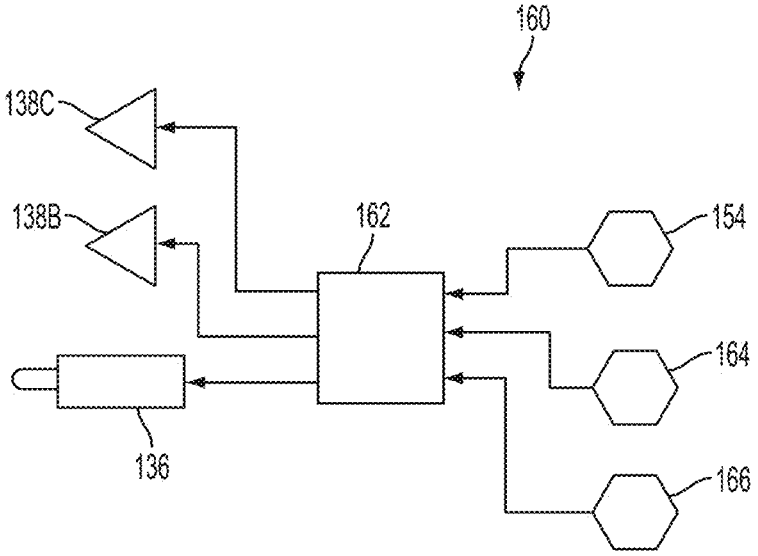
FIG. 4 is an example control diagram for use with embodiments of the current disclosure.
Figure 5:
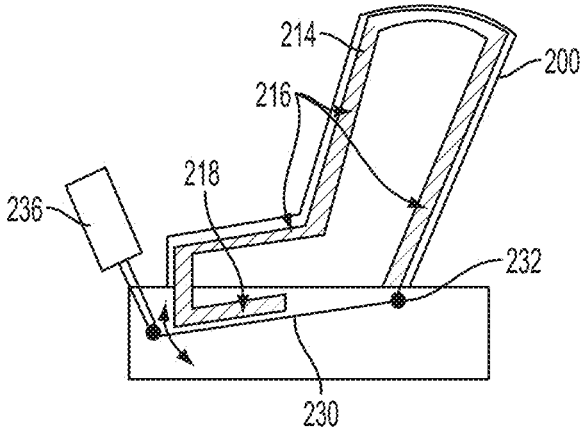
FIG. 5 is a schematic side view of another example compression therapy device according to the current disclosure.
Figure 6:
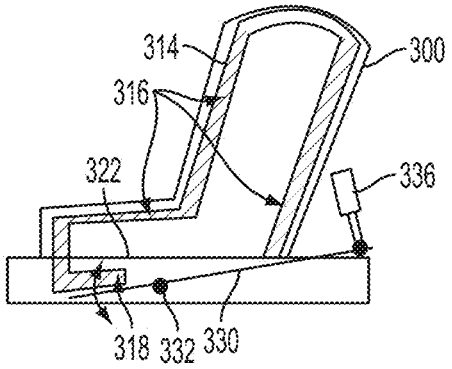
FIG. 6 is a schematic side view of another example compression therapy device according to the current disclosure.
Figure 7:
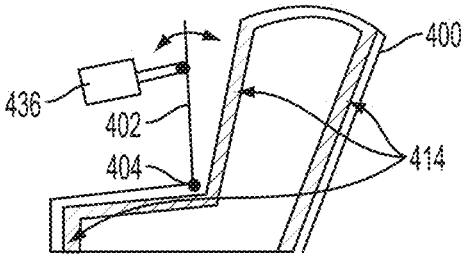
FIG. 7 is a schematic side view of another example compression therapy device according to the current disclosure.
Figure 8:
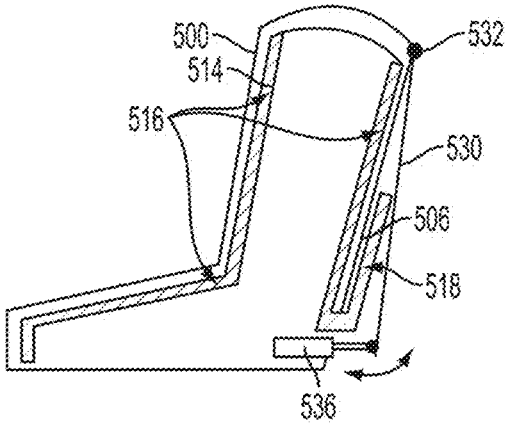
FIG. 8 is a schematic side view of another example compression therapy device according to the current disclosure.
Figure 9:
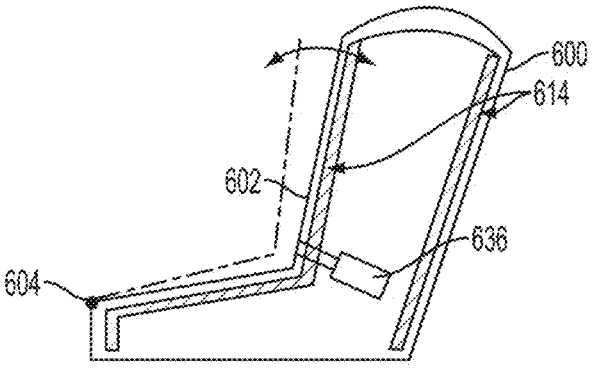
FIG. 9 is a schematic side view of another example compression therapy device according to the current disclosure.

As shown in FIG. 4, an example control system 160 for the current system 10 is diagramed. The control system 160 may include one or more computerized controllers, control circuits and/or microprocessors 162 as known to those of ordinary skill. The controller 162 may have outputs for operating the bladder fill valve 138C, the bladder exhaust valve 138B and/or the actuator 136 (which may include the three-way valve 138A in an exemplary embodiment as discussed above). Inputs to the controller 162 may include the bladder pressure sensor 154, a pulse sensor input 164 and/or a cardiac (e.g., EKG) device 166 input. The controller 162 is configured, through software, circuits and/or hardware, to operate according to the operations described herein.

FIGS. 5-9 illustrate alternative embodiments to the current disclosure. Each embodiment utilizes an actuator to act upon a lever or movable housing component of the boot to cycle the volume of the boot according to a therapeutic timing cycle. In the embodiment of the boot 200 shown in FIG. 5, the lever arm 230 acted upon by actuator 236 is pivotally connected to a posterior portion of the boot by pivot 232, and a reservoir portion 218 of the bladder 214 extends from a toe portion of the boot to be acted upon by the lever arm 230, while the therapeutic portions 216 of the bladder 214 surround the patient's foot and lower leg. In another embodiment of the boot 300 shown in FIG. 6, the lever arm 330 acted upon by actuator 336 is pivotally connected midway between the toe and heel of the boot such that the arm 330 pivots in a see-saw manner about pivot 332. In this embodiment an anterior reservoir portion 318 extends above an anterior portion of the arm 330 (between arm 330 and inner floor 322). This positioning of the pivot 332 with respect to the arm 330 may be desired for higher pressure therapy embodiments. The therapeutic portions 316 of the bladder 314 surround the patient's foot and lower leg. In yet another embodiment of the boot 400 shown in FIG. 7, rather than using a separate lever arm, a portion of the boot housing, such as an anterior wall 402, is acted upon by actuator 436 to cyclically increase and decrease the volume of the boot 400. In the embodiment shown in FIG. 7, the anterior wall 402 is connected via pivot 404 approximate an upper foot portion of the boot. A separate reservoir portion of the bladder 414 is not required in this embodiment since the anterior wall 402 acts directly upon the bladder 414 approximate the patient's shin. In yet another embodiment of the boot 500 shown in FIG. 8, the lever arm 530 acted upon by actuator 536 is pivotally connected approximate an upper end of the posterior portion 506 of the boot at pivot 532 and extends downward along the posterior portion (e.g., from calf to heel). The reservoir portion 518 of the bladder 514 extends out from approximate the heel of the boot 500 and up between the lever arm 530 and the posterior portion 506, while the therapeutic portions 516 of the bladder 514 surround the patient's foot and lower leg. In the embodiment shown in FIG. 9, the anterior portion 602 of the boot 600 is pivotally connected at pivot 604 to the base and posterior portion of the boot and is acted upon by actuator 636. A separate reservoir portion of the bladder 614 is not required in this embodiment since the anterior portion 602 acts directly upon the bladder 614 approximate the patient's shin and upper foot. Obviously, there may be numerous additional configurations that perform substantially the same function of cyclically increase/decreasing the volume of the boot by acting upon a bladder contained within the boot via a mechanical advantage mechanism; all of which are within the scope of the current disclosure.

As shown in FIG. 2, the therapeutic portion 116 of the bladder 114 is a single-chamber bladder design. However, multiple chamber designs for sequential inflation/deflation of the chambers such as may, for example, be desired to treat venous or lymphatic conditions as is known in the art are contemplated and within the scope of the present disclosure. Suitable operator controls (e.g., power switch, pressure selector control, etc.), sensors, indicators, gauges, and/or other operator information and controls may be provided as is known to those of ordinary skill in the art. Additionally, sensors, including various pressure sensors and physiological sensors may be used to assist in the operation of the therapeutic compression device 10 of the present disclosure as well as to help provide the desired therapy.

Generally, program modules for the computer control of the controller 162 may include routines, programs, components, data structures, etc., that perform particular tasks or implement particular abstract data types. Moreover, those skilled in the art will appreciate that the methods according to the present disclosure may be practiced with other computer system configurations, including single-processor or multiprocessor computer systems, minicomputers, mainframe computers, as well as personal computers, hand-held computing devices, microprocessor-based, hardware-based or programmable consumer electronics, and the like.

Some aspects of the present disclosure may also be practiced in distributed computing environments where certain tasks are performed by remote processing devices that are linked through a communications network. In some example distributed computing environments, program modules may be located in local and/or remote memory storage devices.

Figure 10:
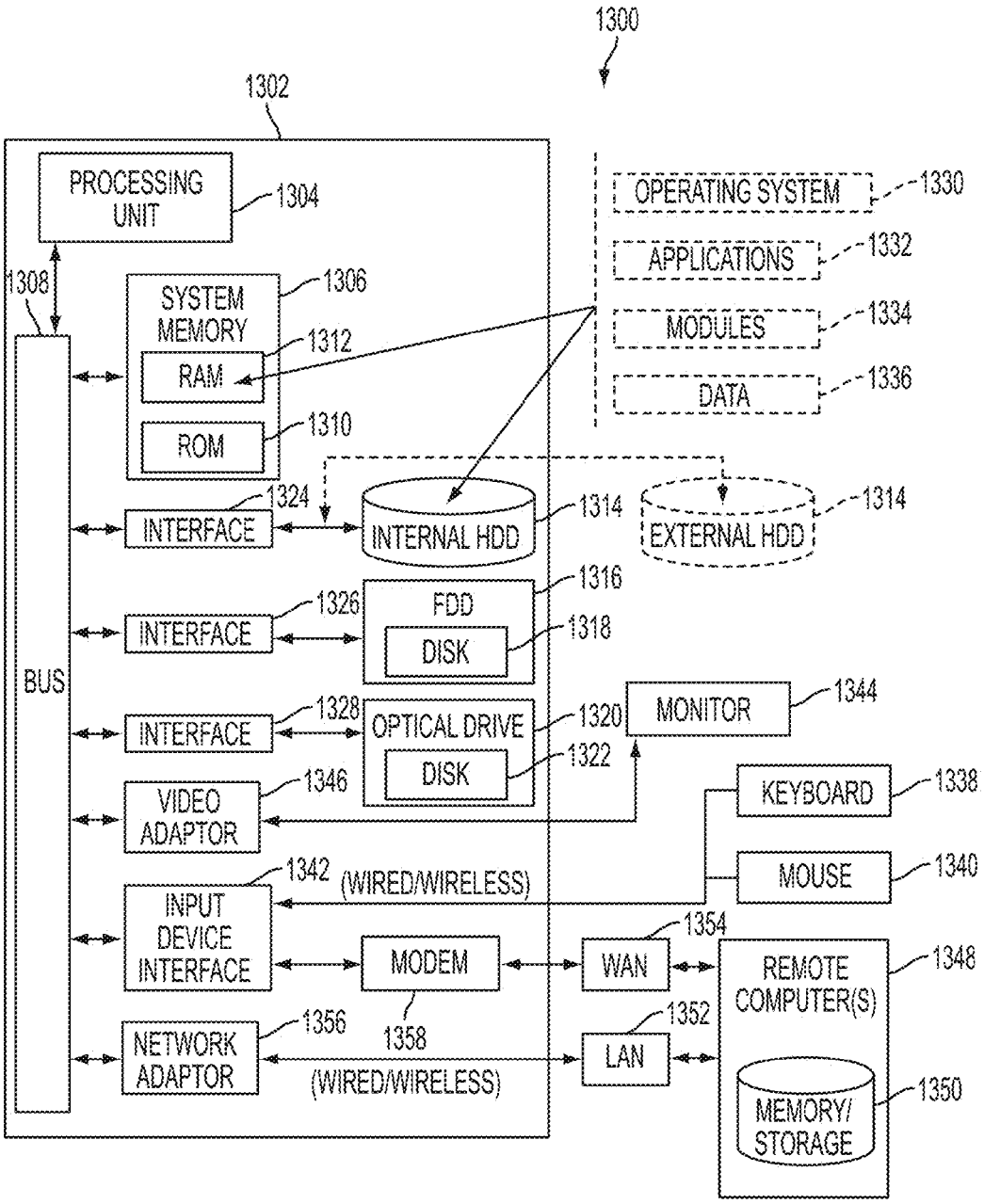
FIG. 10 is a block diagram of an example computer suitable for use in connection with the compression therapy device of the present disclosure.

As shown in FIG. 10, an example computer controller may include a variety of computer-readable media. Computer-readable media may include any available media that can be accessed by the computer and includes both volatile and non-volatile media, as well as removable and non-removable media. By way of example, and not limitation, computer-readable media may comprise computer storage media and communication media. Computer storage media may include volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital video disk (DVD) or other optical disk storage, magnetic cassettes, magnetic tape, magnetic disk storage or other magnetic storage devices, or any other medium which can be used to store the desired information and which can be accessed by the computer.

An example computing environment 1300 for implementing various aspects includes a computer 1302, which may include a processing unit 1304, a system memory 1306 and/or a system bus 1308. The system bus 1308 may couple system components including, but not limited to, the system memory 1306 to the processing unit 1304. The processing unit 1304 can be any of various commercially available processors. Dual microprocessors and other multi-processor architectures may also be employed as the processing unit 1304.

The system bus 1308 can be any of several types of bus structures that may further interconnect to a memory bus (with or without a memory controller), a peripheral bus, and/or a local bus using any of a variety of commercially available bus architectures. The system memory 1306 may include read only memory (ROM) 1310 and/or random access memory (RAM) 1312. A basic input/output system (BIOS) may be stored in a non-volatile memory 1310 such as ROM, EPROM, EEPROM. BIOS may contain basic routines that help to transfer information between elements within the computer 1302, such as during start-up. The RAM 1312 can also include a high-speed RAM such as static RAM for caching data.

The computer 1302 may further include an internal hard disk drive (HDD) 1314 (e.g., EIDE, S ATA), which may also be configured for external use in a suitable chassis, a magnetic floppy disk drive (FDD) 1316 (e.g., to read from or write to a removable diskette 1318), and/or an optical disk drive 1320 (e.g., reading a CD-ROM disk 1322 or, to read from or write to other high capacity optical media such as the DVD). The hard disk drive 1314, magnetic disk drive 1316, and/or optical disk drive 1320 can be connected to the system bus 1308 by a hard disk drive interface 1324, a magnetic disk drive interface 1326, and an optical drive interface 1328, respectively. The interface 1324 for external drive implementations may include at least one or both of Universal Serial Bus (USB) and IEEE 1394 interface technologies. Other external drive connection technologies are within the scope of the disclosure.

The drives and their associated computer-readable media may provide nonvolatile storage of data, data structures, computer-executable instructions, and so forth. For the computer 1302, the drives and media may accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in an example operating environment, and further, that any such media may contain computer-executable instructions.

A number of program modules can be stored in the drives and RAM 1312, including an operating system 1330, one or more application programs 1332, other program modules 1334, and/or program data 1336. All or portions of the operating system, applications, modules, and/or data can also be cached in the RAM 1312. It is to be appreciated that various commercially available operating systems or combinations of operating systems may be utilized.

A user can enter commands and information into the computer 1302 through one or more wired/wireless input devices, e.g., a keyboard 1338 and a pointing device, such as a mouse 1340. Other input devices may include a microphone, an IR remote control, a joystick, a game pad, a stylus pen, touch screen, or the like. These and other input devices are often connected to the processing unit 1304 through an input device interface 1342 that is coupled to the system bus 1308, but can be connected by other interfaces, such as a parallel port, an IEEE 1394 serial port, a game port, a USB port, an IR interface, etc.

A monitor 1344 or other type of display device may also connected to the system bus 1308 via an interface, such as a video adapter 1346. In addition to the monitor 1344, a computer typically includes other peripheral output devices, such as speakers, printers, etc.

The computer 1302 may operate in a networked environment using logical connections via wired and/or wireless communications to one or more remote computers, such as a remote computer(s) 1348. The remote computer(s) 1348 can be a workstation, a server computer, a router, a personal computer, portable computer, microprocessor based entertainment appliance, a peer device, and/or other common network node, and/or may include many or all of the elements descrisupport structure relative to the computer 1302, although, for purposes of brevity, only a memory/storage device 1350 is illustrated. The logical connections depicted include wired/wireless connectivity to a local area network (LAN) 1352 and/or larger networks, e.g., a wide area network (WAN) 1354. Such LAN and WAN networking environments are commonplace in offices and health care facilities, and facilitate enterprise-wide computer networks, such as intranets, all of which may connect to a global communications network, e.g., the Internet.

When used in a LAN networking environment, the computer 1302 may be connected to the local network 1352 through a wired and/or wireless communication network interface or adapter 1356. The adaptor 1356 may facilitate wired or wireless communication to the LAN 1352, which may also include a wireless access point disposed thereon for communicating with the wireless adaptor 1356.

When used in a WAN networking environment, the computer 1302 can include a modem 1358, or may be connected to a communications server on the WAN 1354, or may have other devices for establishing communications over the WAN 1354, such as by way of the Internet. The modem 1358, which can be internal or external and a wired or wireless device, may be connected to the system bus 1308 via the serial port interface 1342. In a networked environment, program modules depicted relative to the computer 1302, or portions thereof, can be stored in the remote memory/storage device 1350. It will be appreciated that the network connections shown are exemplary and other means of establishing a communications link between the computers can be used.

The computer 1302 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag, and/or telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a support structure in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11x (a, b, g, etc.) to provide secure, reliable, fast wireless connectivity. A Wi-Fi network can be used to connect computers to each other, to the Internet, and to wired networks (which use IEEE 802.3 or Ethernet). Wi-Fi networks can operate in the unlicensed 2.4 and 5 GHz radio bands. IEEE 802. 11 applies to generally to wireless LANs and provides 1 or 2 Mbps transmission in the 2.4 GHz band using either frequency hopping spread spectrum (FHSS) or direct sequence spread spectrum (DSSS). IEEE 802.11a is an extension to IEEE 802.11 that applies to wireless LANs and provides up to 54 Mbps in the 5 GHz band. IEEE 802.1 a uses an orthogonal frequency division multiplexing (OFDM) encoding scheme rather than FHSS or DSSS. IEEE 802.11b (also referred to as 802.11 High Rate DSSS or Wi-Fi) is an extension to 802.11 that applies to wireless LANs and provides 11 Mbps transmission (with a fallback to 5.5, 2 and 1 Mbps) in the 2.4 GHz band. IEEE 802.11g applies to wireless LANs and provides 20+ Mbps in the 2.4 GHz band. Products can operate in more than one band (e.g., dual band), so the networks can provide real-world performance similar to the basic I0BaseT wired Ethernet networks used in many offices.

While example embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

The invention claimed is:

1. A compression therapy boot comprising:

a boot;

a bladder adapted to be applied against at least a portion of a patient's lower leg and foot, said bladder being pre-filled with at least one of a gas, a liquid and non-Newtonian liquid at a pre-set fill pressure, said bladder including a therapeutic portion surrounding said portion of at least one of a patient's lower leg and foot, and a reservoir portion, said reservoir portion being located in a reservoir cavity in said boot formed by an inner floor located in said boot;

a lever arm shaped and oriented to compress against said bladder reservoir portion in a first position and at least partially release compression against said bladder reservoir portion in a second position;

an actuator coupled to said lever arm such that actuation of said actuator causes said lever arm to pivot to said first position; and, a control operatively coupled to said actuator and configured to actuate said actuator in a cyclic manner according to at least one of therapeutic timing cycles.

2. The compression therapy boot of claim 1 wherein said lever arm is pivoted about a pivot located proximal to one of a toe end and a heel end of said boot.

3. The compression therapy boot of claim 2 wherein actuation of said actuator causes said lever arm to compress said reservoir portion against a bottom of said inner floor.

4. The compression therapy boot of claim 1 wherein said actuator comprises a pneumatic piston in fluid communication with a pneumatic pressure source.

5. The compression therapy boot of claim 1 further comprising a pressure sensor for sensing a pneumatic pressure in the bladder and a controller for controlling a fill valve of said bladder based upon input from said pressure sensor.

6. The compression therapy boot of claim 1 wherein said lever arm forms a structural wall of said boot.

7. The compression therapy boot of claim 1 wherein said control includes input from a patient heart-rate monitor and the therapeutic timing cycle is based, at least in part, upon signals received from said patient heart-rate monitor.

8. The compression therapy boot of claim 1 wherein said at least one of therapeutic timing cycles is programmed into the control.

9. The compression therapy boot device of claim 1, wherein pressure within said bladder pivots said lever arm back to said second position when said actuator is deactuated.

10. A compression therapy device comprising:

a bladder adapted to be applied against at least a portion of a patient's body, said bladder being pre-filled with at least one of a gas, a liquid and non-Newtonian liquid at a pre-set fill pressure;

a lever arm shaped and oriented to compress against said bladder in a first position and at least partially release compression against said bladder in a second position;

an actuator coupled to said lever arm such that actuation of said actuator causes said lever arm to pivot to said first position, said actuator comprising a pneumatic piston in fluid communication with a pneumatic pressure source, and a three-way valve located between said pneumatic piston and said pneumatic pressure source, said three-way valve capable of controlling the pneumatic piston; and, a control operatively coupled to said actuator and configured to actuate said actuator in a cyclic manner according to at least one of therapeutic timing cycles.

11. A compression therapy device comprising:

a bladder adapted to be applied against at least a portion of a patient's body, said bladder being pre-filled with at least one of a gas, a liquid and non-Newtonian liquid at a pre-set fill pressure;

a lever arm shaped and oriented to compress against said bladder in a first position and at least partially release compression against said bladder in a second position;

an actuator coupled to said lever arm such that actuation of said actuator causes said lever arm to pivot to said first position;

a control operatively coupled to said actuator and configured to actuate said actuator in a cyclic manner according to at least one of therapeutic timing cycles;

wherein said bladder is in fluid communication with a pneumatic pressure source via a fill-valve controlled by said control; and, said actuator comprises a pneumatic piston in fluid communication with said pneumatic pressure source via an actuator valve controlled by said control.

12. A method of compression therapy comprising the steps of:

selecting a compression therapy device having a housing containing a bladder adapted to be applied against at least a portion of a body part of a patient, a pressure source for providing at least one of pneumatic and hydraulic pressure within said bladder, a lever arm shaped and oriented to compress against an outer surface of said bladder when pivoted to a first position and to at least partially release compression against said outer surface of said bladder when pivoted to a second position, and an actuator attached to said lever arm such that actuation of said actuator pivots said lever arm to said first position, thereby creating an increased pressure within said bladder, wherein said bladder is in fluid communication with said pressure source via a fill-valve controlled by a control and said actuator comprises a piston in fluid communication with said pressure source via an actuator valve controlled by said control;

actuating said actuator to pivot said lever arm to said first position;

inserting a body part of the patient into said housing and against said bladder;

inflating said bladder by said pressure source to a maximum desired therapeutic pressure;

cyclically operating said actuator to pivot said lever arm at least between said first and second positions according to a therapeutic timing cycle.

13. The compression therapy method of claim 12 further comprising the step of cyclically operating said actuator based upon physiological readings from said patient.

14. The compression therapy method of claim 12 further comprising the step of cyclically operating said actuator according to a pre-set timing program.

15. The compression therapy method of claim 12 wherein said housing is in a shape of a boot and said bladder surrounds at least a portion of said patient's lower leg or foot when said patient's lower leg or foot is inserted into said housing.

* * * * *